US005420932A

United States Patent [19]

Goodman

[11] Patent Number: 5,420,932

[45] Date of Patent: May 30, 1995

[54] ACTIVE ACOUSTIC ATTENUATION SYSTEM THAT DECOUPLES WAVE MODES PROPAGATING IN A WAVEGUIDE

[75] Inventor: Seth D. Goodman, Madison, Wis.

[73] Assignee: Digisonix, Inc., Middleton, Wis.

[21] Appl. No.: 110,559

[22] Filed: Aug. 23, 1993

[51] Int. Cl.[6] ..... G10K 11/16
[52] U.S. Cl. ..... 381/71
[58] Field of Search ..... 381/71, 94

[56] References Cited

U.S. PATENT DOCUMENTS

| | | | |
|---|---|---|---|
| 4,677,676 | 6/1987 | Eriksson . | |
| 4,815,139 | 3/1989 | Erickson | 381/71 |
| 4,837,834 | 6/1989 | Allie . | |
| 4,987,598 | 1/1991 | Eriksson . | |
| 5,022,082 | 6/1991 | Eriksson et al. . | |
| 5,216,721 | 6/1993 | Melton . | |
| 5,216,722 | 6/1993 | Popovich . | |
| 5,237,618 | 8/1993 | Bethel | 381/71 |
| 5,283,834 | 2/1994 | Goodman et al. | 381/71 |

OTHER PUBLICATIONS

"Higher Order Mode Effects in Circular Ducts and Expansion Chambers", J. Acoust. Soc. Am. 68(2) Aug., 1980, L. J. Eriksson.

"Development of the Filtered-U Algorithm for Active Noise Control", J. Acoust. Soc. Am. 89(1), Jan., 1991, L. J. Eriksson.

"Higher Order Mode Cancellation in Ducts Using Active Noise Control", Paper presented at Newport Beach, Calif. conference inter-noise, Dec. 4-6, 1989.

*Primary Examiner*—Forester W. Isen
*Attorney, Agent, or Firm*—Andrus, Sceales, Starke & Sawall

[57] ABSTRACT

An active acoustic attenuation system and method which operates in a waveguide (i.e. duct or beam) to attenuate acoustic waves having energy in the plane wave node and in higher order nodes. The invention does this by sensing the acoustic wave at linearly independent locations across a waveguide, decoupling the signals to generate an independent signal for each node being attenuated, processing the signal for each node independently of one another, and combining the processed signals for each node to drive a set of actuators at linearly independent locations across a waveguide. The invention is useful for both sound control and vibration control.

65 Claims, 8 Drawing Sheets

FIG. 12
PRIOR ART
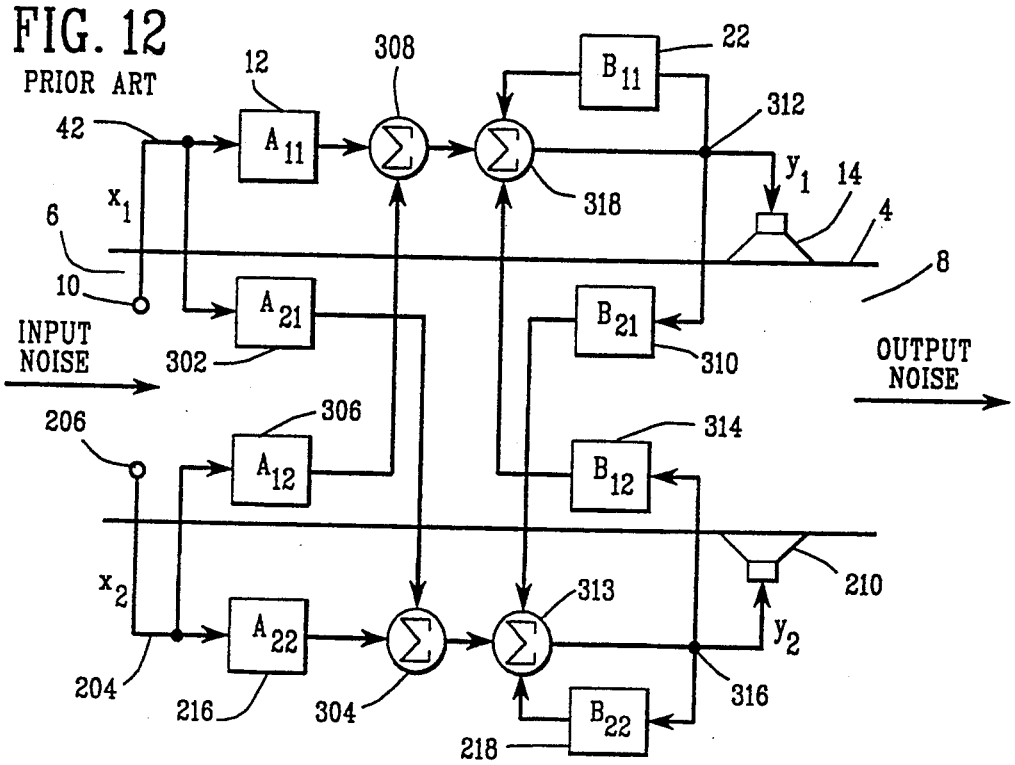
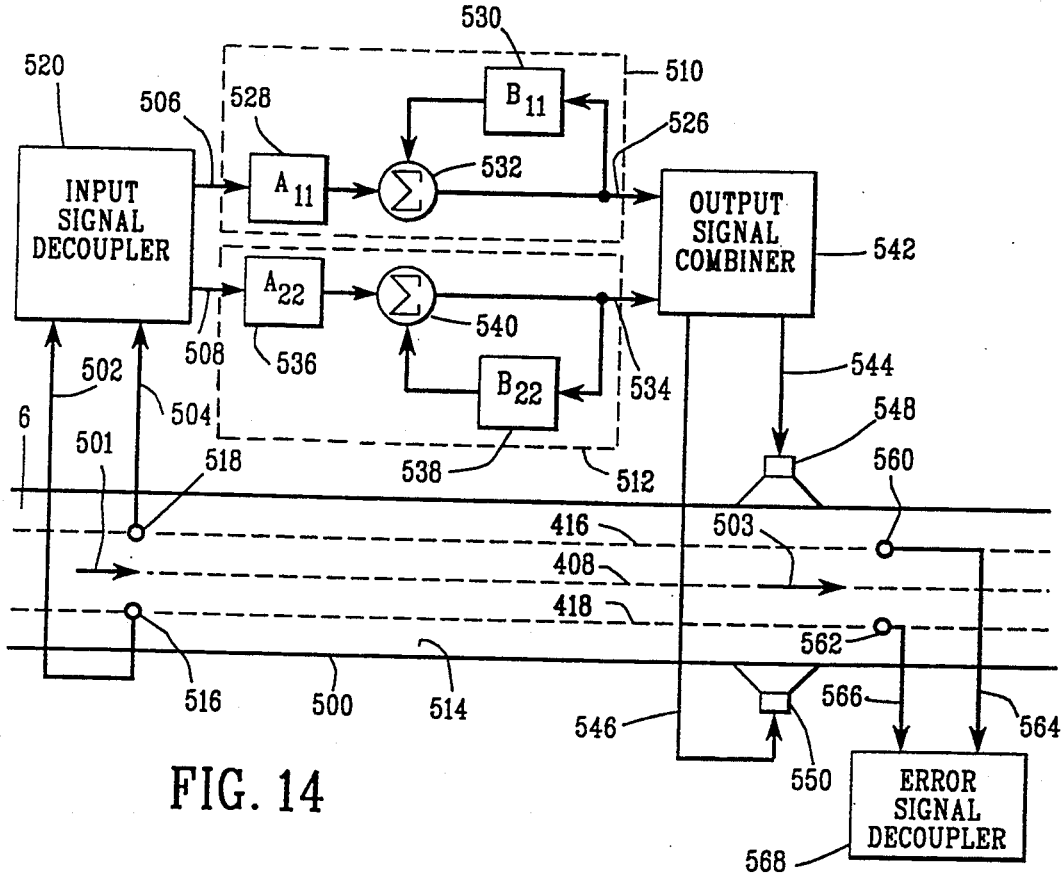
FIG. 14 n INPUT SIGNALS n OUTPUT SIGNALS n ERROR SIGNALS

ACTIVE ACOUSTIC ATTENUATION SYSTEM THAT DECOUPLES WAVE MODES PROPAGATING IN A WAVEGUIDE

BACKGROUND OF THE INVENTION

The invention relates to active acoustic attenuation systems operating in a waveguide where an acoustic wave propagates longitudinally through the waveguide and has plane wave mode and higher order mode transverse modal energy. In particular, the invention relates to a system where the various modes are decoupled before the acoustic system is modeled in an adaptive filter model.

The invention arose during continuing development efforts relating to active acoustic attenuation systems, including the subject matter shown and described in U.S. Pat. Nos. 4,677,676; 4,815,139; 4,837,834; 4,987,598; 5,022,082, 5,216,721; and 5,216,722, all of which are assigned to the assignee of the present invention and are incorporated herein by reference.

At low frequencies, sound propagates down a duct as a series of plane waves. Above a critical "cut-on" frequency, however, sound can propagate in the plane wave mode plus one or more higher order modes. Each higher order mode has a cut-on frequency. The cut-on frequency for each higher order mode depends on the velocity of sound through the duct and the duct geometry. Above the cut-on frequency for a specific mode, the wave mode is stable and propagates without attenuation. Below the cut-on frequency, the mode decays exponentially as it propagates down the duct after it has been excited. Commercial air duct systems typically have a large enough cross section to support one or more higher order modes in the frequency range of interest for active noise control.

In general, active acoustic attenuation systems inject a canceling acoustic wave to destructively interfere with and cancel an input acoustic wave. Referring to FIGS. 1 and 3, it is typical to sense the input acoustic wave with an input microphone and the output acoustic wave with an error microphone. The input microphone supplies an input or feedforward signal to an electronic controller, and the error microphone supplies an error or feedback signal to the electronic controller. The electronic controller, in turn, supplies a correction signal to a canceling loudspeaker, which injects a canceling acoustic wave to destructively interfere with the input acoustic wave, such that the output acoustic wave at the error microphone is zero (or at least reduced). If a sound wave propagating down the duct is a plane wave having uniform pressure across the duct, the location across the duct of the microphone and the canceling loudspeaker does not matter. However, if the acoustic spectrum extends above the first higher order mode cut-on frequency, there may be energy in several modes. In this case, a single channel or single-input-single-output (SISO) system as shown in FIGS, 1 and 3 gives poor cancellation above the modal cut-on frequency and may even add acoustic power or become unstable.

The modal distribution of acoustic energy can become complicated. Referring to FIG. 8, an instantaneous pressure distribution in a cross sectional plane normal to the longitudinal axis of a rectangular duct is shown for each of several modes. The symbols "+" and "−" denote regions of positive and negative instantaneous pressure. Separating these regions are planes of zero pressure called nodal planes. The pressure will vary sinusoidally in time in the "+" and "−" regions, but will always be zero on the nodal planes.

As shown in FIG. 8, the pressure distribution across a duct can become complicated inasmuch as nodal planes associated with higher order modes can occur along both horizontal planes (designated as n) and vertical planes (designated as m). As explained by Eriksson, "Higher Order Mode Effects In Circular Ducts and Expansion Chambers", J. Acoust. Soc. Am. 68(2), August 1980, the cut-on frequency, $f_c$, in Hertz, for each (m,n) mode in a rectangular duct is given by:

$$f_c = \left(\frac{c}{2\pi}\right)\left[\left(\frac{m\pi}{a}\right)^2 + \left(\frac{n\pi}{b}\right)^2\right]^{\frac{1}{2}} \qquad \text{Eq. 1}$$

where c is the velocity of sound in meters/second, a and b are the lengths of the sides of the duct in meters, and m and n are integers 0,1,2, . . . . In the above-cited paper, Eriksson also discloses a similar analysis for circular ducts. It can be appreciated from Equation (1) and FIG. 8 that the modal distribution of acoustic energy can become complicated when multiple modes are propagating.

A single-input-single-output (SISO) system cancels the plane wave mode. Multiple-input-multiple-output (MIMO) systems have been developed, and improve attenuation of multiple modes. Examples of MIMO systems are the systems disclosed in U.S. Pat. Nos. 4,815,319, 5,216,721, and 5,216,722.

An adaptive 2-x-2 MIMO controller with infinite impulse response (IIR) filters as described in the above referenced U.S. Pat. No. 5,216,721 to Melton is shown in FIG. 12. The 2-x-2 MIMO controller shown in FIG. 12 requires about four times the computational power as the SISO controller shown in FIGS. 1 and 3. In addition, a like amount of computational power is required to model error or feedback signals in the same manner.

A 3-x-3 MIMO controller demanding 9 times the computational power of a SISO controller is required to control an input disturbance consisting of a plane wave plus the first two higher order modes. In general, controlling n modes requires an n-x-n MIMO controller, which demands $n^2$ times the computational resources of a SISO controller. Although it is possible in the prior art to use a system that does not require $n^2$ times the computing power of a SISO controller, such a system will not in all circumstances completely characterize the input disturbance. The result will be poor attenuation, unwanted addition of acoustic energy or instability. This is especially true when the range of frequency of the input disturbance is broad and the acoustic profile becomes distorted quickly as the disturbance travels down the duct.

SUMMARY OF THE INVENTION

The present invention provides a system and a method for attenuating acoustic disturbances having multiple propagating modes in which input and/or error sensors are located in such a manner that the signals from the sensors can be decoupled to result in a separate processing signal for each of the various modes being attenuated. The decoupled processing signal for each mode can be processed with a dedicated single channel filter to generate a separate modal output signal for each mode. The separate modal output signals can then be combined in such a manner so that actuators (e.g. loudspeakers) driven by the combined output signals can attenuate each of the various modes independently.

In such a system, the cross-coupled filter elements described in U.S. Pat. No. 5,216,721 are nonexistent. Thus, multiple mode acoustic waves can be attenuated as effectively as with a multi-channel interconnected active acoustic attenuation system, except with much lower computational processing requirements.

It is thus an object of the present invention to reduce the computational processing requirements for attenuating multiple mode acoustic waves in a waveguide.

Another more specific object of the present invention is to do the same without reducing system stability and/or attenuation effectiveness.

The invention is particularly suited for attenuating sound energy propagating as plane wave and higher order mode waves down a duct. The invention is also well suited for attenuating vibrational energy in analogous situations involving a vibrational waveguide, such as a beam or plate.

DESCRIPTION OF THE DRAWINGS

Prior Art

FIG. 12 is a schematic illustration of a multi-channel active acoustic attenuation system in accordance with above incorporated U.S. Pat. No. 5,216,721.

Present Invention

FIG. 14 is a schematic illustration of an active acoustic attenuation system in accordance with the present invention.

Figure 15:
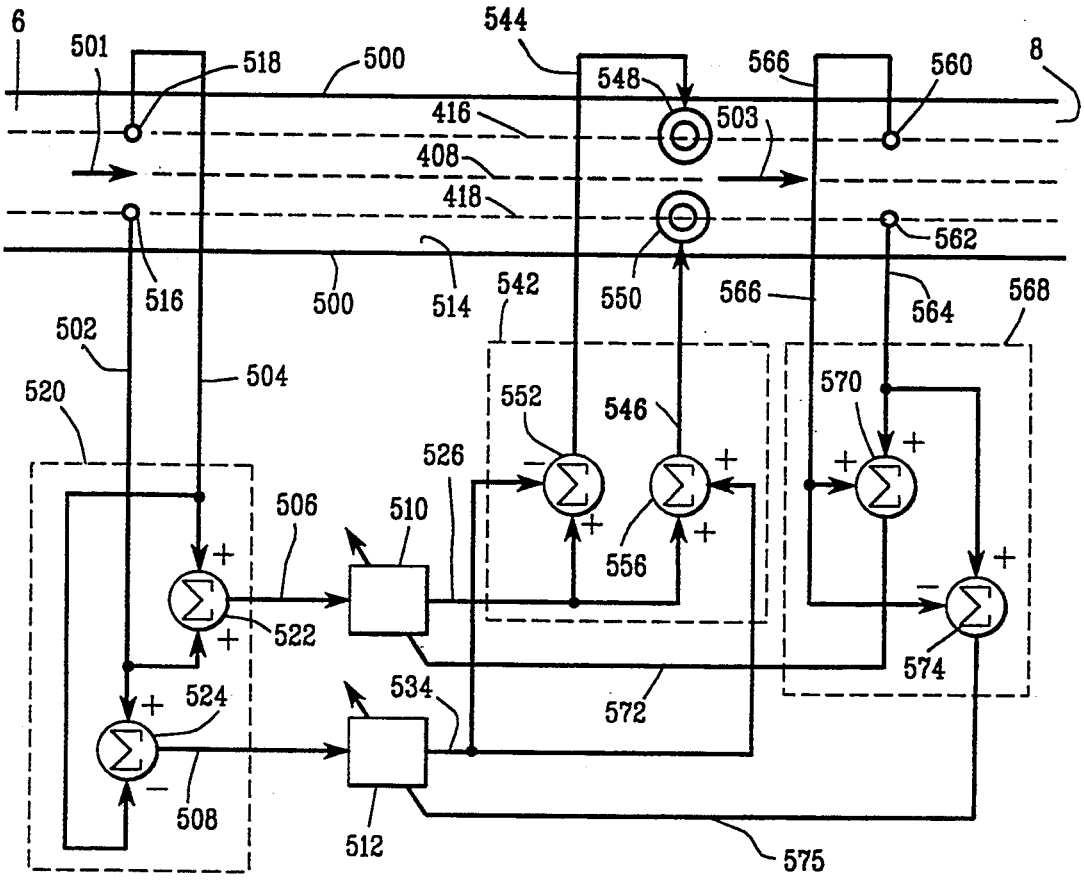

FIG. 15 is a schematic illustration showing a further embodiment of the present invention.

Figure 16:
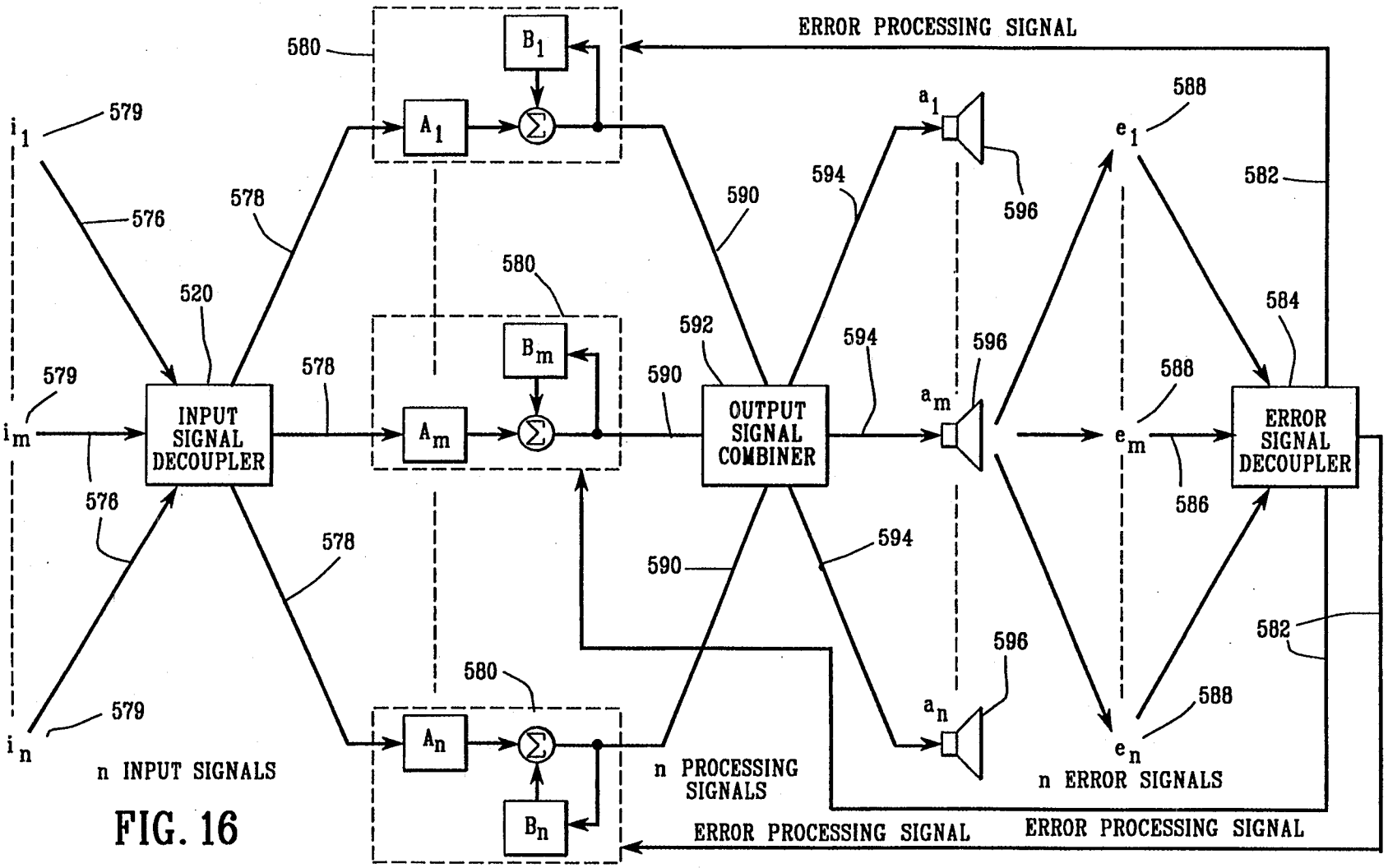

FIG. 16 is a schematic illustration showing a generalized system of the present invention.

DETAILED DESCRIPTION

Prior Art

Figure 1:
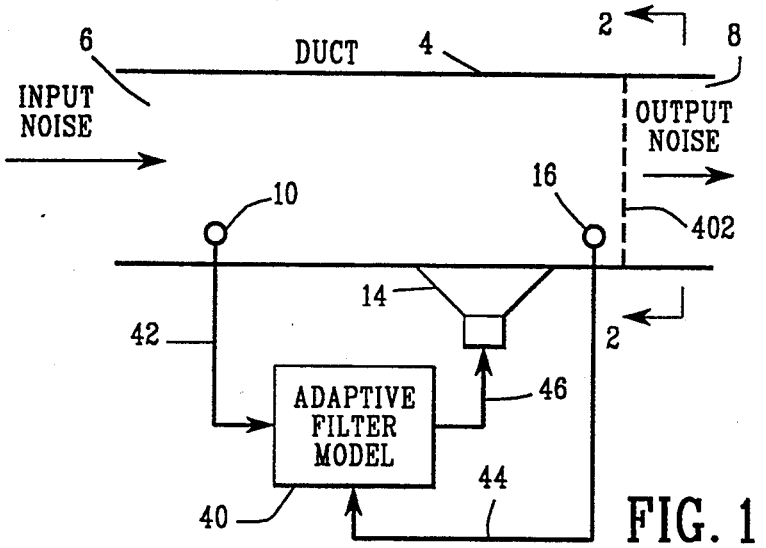
FIG. 1 PRIOR ART
FIG. 1 is a schematic illustration of an acoustic modeling system in accordance with the above referenced and incorporated U.S. Pat. No. 4,677,676.

FIG. 1 shows an active acoustic attenuation system in accordance with incorporated U.S. Pat. No. 4,677,676 (see FIG. 5 in the referenced patent) and like reference numerals are used from these patents where appropriate to facilitate understanding. For further background, reference is also made to "Development of the Filtered-U Algorithm for Active Noise Control", L. J. Eriksson, *Journal of the Acoustic Society of America,* 89 (1), January, 1991, pages 257–265. It should be noted that throughout the drawings, the systems are depicted as sound attenuation systems; however, the invention is not limited to sound attenuation systems and includes other acoustic attenuation systems such as vibrational attenuation systems.

The system shown in FIG. 1 includes a waveguide shown as a duct 4. The system has an input 6 for receiving an input acoustic wave, e.g., input noise, and an output 8 for radiating or transmitting an output acoustic wave, e.g., output noise. An input sensor (e.g. transducer) such as an input microphone 10 senses the input acoustic wave. An actuator (e.g. output transducer) such as a loudspeaker 14 introduces a canceling acoustic wave to attenuate the input acoustic wave and yield an attenuated output acoustic wave. An error sensor (e.g. transducer) such as an error microphone 16 senses the output acoustic wave and provides an error signal at 44. An adaptive filter at 40 adaptively models the acoustic path from the input sensor 10 to the actuator 14. The adaptive filter model has a model input 42 from input sensor 10, an error input 44 from error sensor 16, and a model output 46 outputting a correction signal to the actuator 14 to introduce the canceling acoustic wave. The adaptive filter model 40 uses a transfer function M which, when operated on input x, yields output y (i.e. correction signal at 46):

$$Mx=y \qquad \text{Eq. 2}$$

Figure 3:
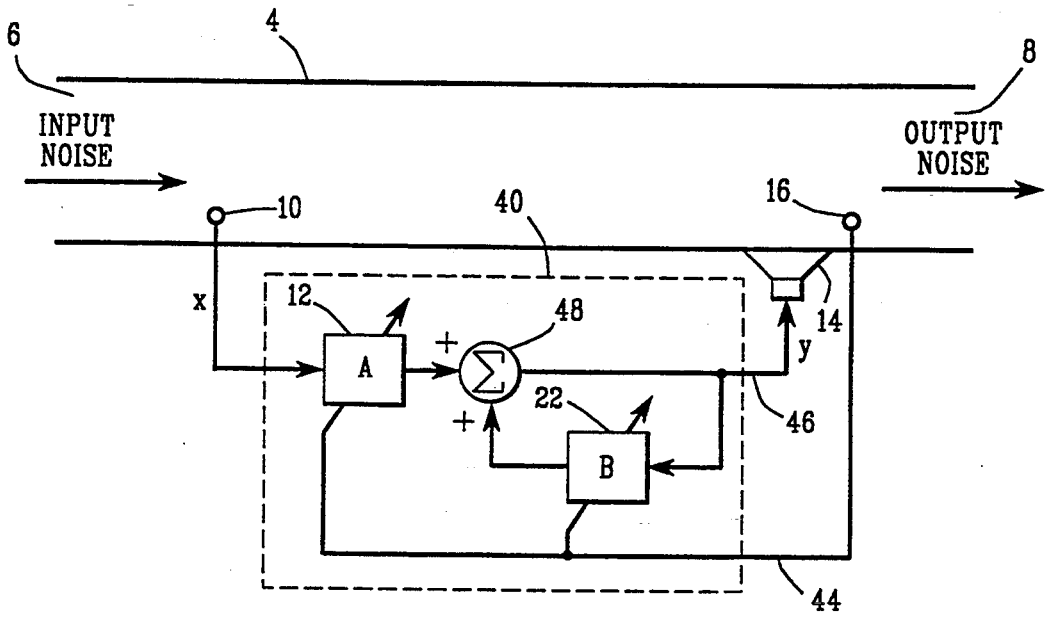
FIG. 3 PRIOR ART
FIG. 3 is a schematic illustration showing the system of FIG. 1, but further showing a recursive, adaptive filter model.

As noted in incorporated U.S. Pat. No. 4,677,676, the model 40 is an adaptive, recursive filter having a transfer function with both poles and zeros. Referring to FIG. 3, the model 40 is provided by a recursive least mean square (RLMS) filter having a first algorithm provided by LMS filter A at 12, and a second algorithm provided by LMS filter B at 22. Filter A provides a direct transfer function, and filter B provides a recursive transfer function. The outputs of filters A and B are summed at summer 48, whose output provides a correction signal (i.e. y) on line 46. In particular, filter A multiplies input signal x by transfer function A to provide the term Ax, which appears below in Equation 3. Filter B multiplies its input signal y by transfer function B to yield the term By in Equation 3. Summer 48 adds the terms Ax and By to yield a resultant sum y, which is the model output correction signal on line 46:

$$Ax+By=y \qquad \text{Eq. 3}$$

Solving equation 3 for y yields:

$$y=\left(\frac{A}{1-B}\right)x \qquad \text{Eq. 4}$$

Figure 2:
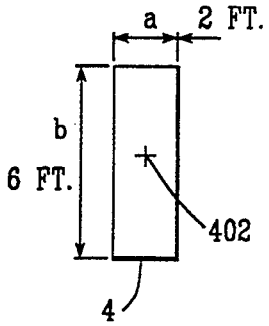
FIG. 2 is a sectional view of the duct of FIG. 1 and shows the acoustic pressure distribution of the plane wave mode.

FIG. 1 shows an acoustic wave 402 (i.e. plane wave (0,0) mode) propagating longitudinally along the duct 4. FIG. 2 shows a cross-sectional view of duct 4 at a given instant in time, where the duct 4 has transverse dimensions of 2 feet×6 feet. According to Eq. 1, the cut-on frequency $f_c$ for the first higher order mode (i.e. (0,1) mode) of an acoustic wave traveling longitudinally in the duct 4 (i.e. out of the page in FIG. 2) is given by $f_c=c/2b$, where $f_c$ is a cut-on frequency, c is the speed of sound in the duct 4, and b is the longer of the traverse dimensions of the duct 4, namely 6 feet. In the example given, assuming that the speed of sound through the duct 4 is 1130 feet per second, the cut-on frequency for the first higher order mode is 94 Hz. For acoustic frequencies below 94 Hz, only plane and uniform pressure acoustic waves propagate along the duct 4. The plane wave 402 is depicted in FIGS. 1 and 2 as having a positive pressure across the entire transverse dimension of the duct 4 at a given instant in time, which is shown as a "+" 402 in FIG. 2.

Figure 4:
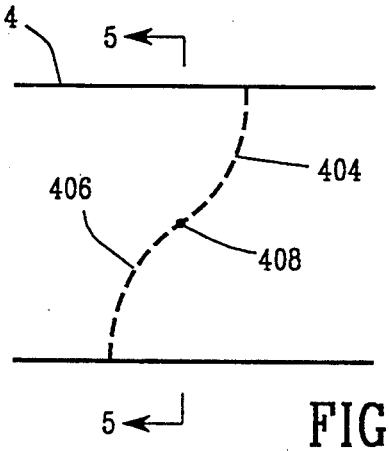
FIG. 4 is a schematic illustration showing the duct of FIG. 1 and the acoustic pressure distribution of the first higher order mode.

At acoustic frequencies greater than the cut-on frequency for the first higher order mode (i.e. (0,1) mode), there may be a non-uniform acoustic pressure wave at a given instant in time across the duct 4 due to higher order modes. FIG. 4 shows the first higher order mode (i.e. (0,1) mode) wherein the acoustic frequency is greater than $f_c$ for the first higher order mode. In the example shown, for a 2 foot×6 foot duct 4, the cut-on frequency is 94 Hz. The acoustic wave associated with the first higher order mode, at a given instant in time has a positive pressure portion 404 as shown in FIG. 4 and in FIG. 5 as "+" 404. At the same instance in time, the acoustic wave associated with the first higher order mode also has a negative pressure portion 406 as shown in FIG. 4 and in FIG. 5 as "−" 406. The first higher order mode has a node 408 between the wave portions 404 and 406.

Figure 6:
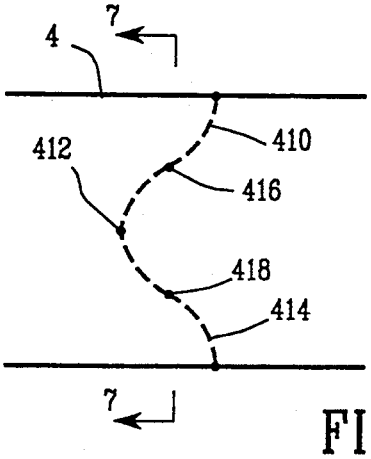
FIG. 6 is a schematic illustration showing the duct of FIG. 1 and acoustic pressure distribution of the second high order mode.
Figure 7:
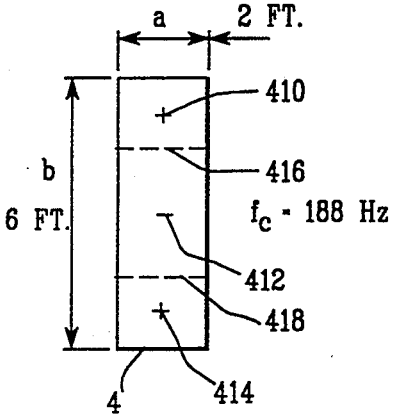
FIG. 7 is a sectional view of the acoustic pressure distribution taken along line 7—7 of FIG. 6.

FIGS. 6 and 7 show the second higher order mode (i.e. (0,2) mode) having a portion 410 of positive pressure, a portion 412 of negative pressure, and a portion 414 of positive pressure. The cut-on frequency for the second higher order mode is 188 Hz. The second higher order mode has two pressure nodes, 416 and 418, each separating a positive and negative pressure portion of the acoustic wave. Further higher order modes continue in a like manner. For example, a third higher order mode (i.e. (0,3) mode) associated with the transverse dimension b has four portions separated by three pressure nodes at any given instant in time.

Figure 8:
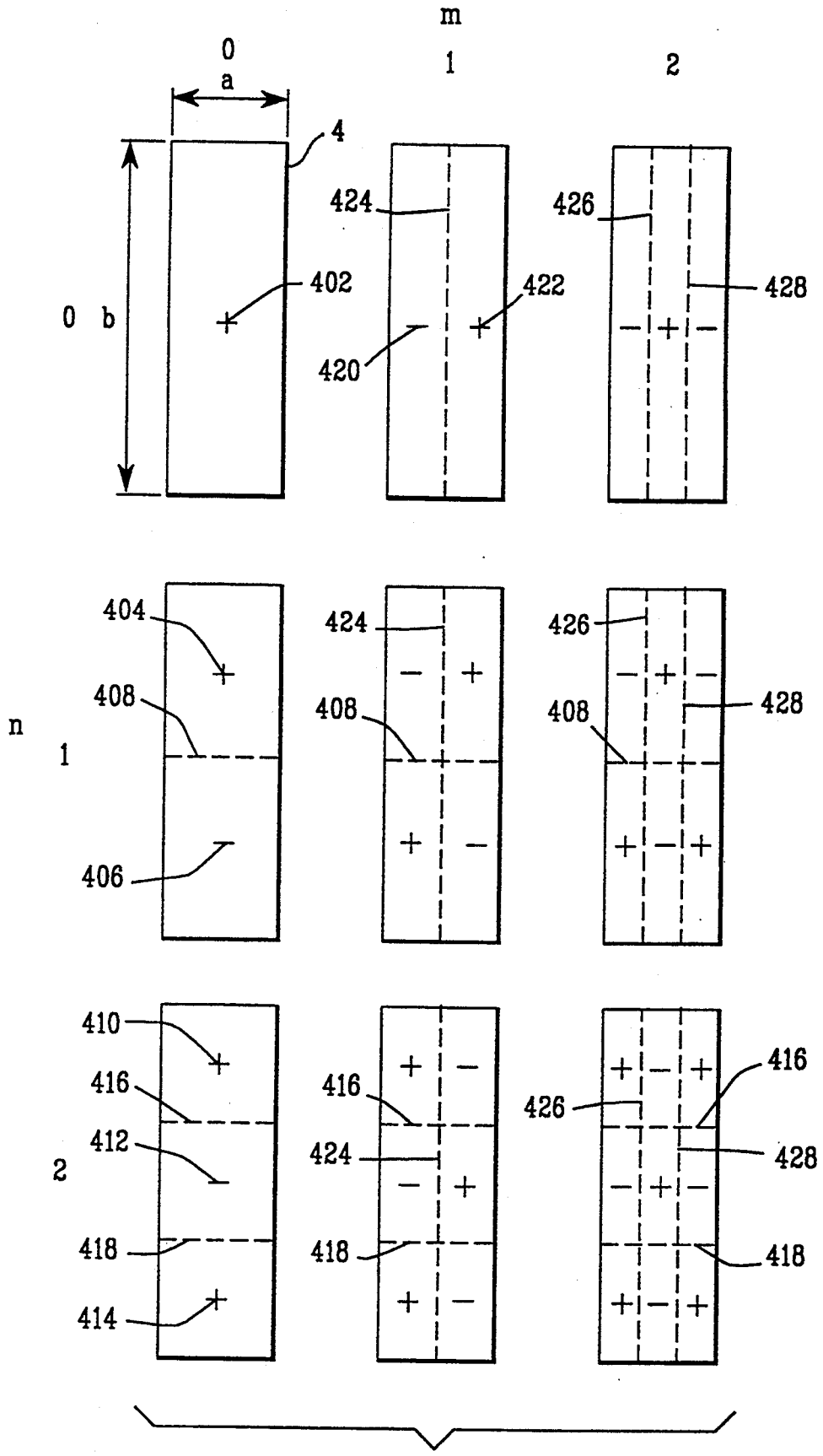
FIG. 8 is a schematic illustration showing plane wave and higher order mode pressure distribution in a duct.

Referring to FIG. 8, depending on duct 4 dimensions, higher order modes can also give rise to a non-uniform acoustic pressure along the shorter of the transverse dimensions of a duct 4 (i.e. side a). For instance, in FIG. 8, the (1,0) mode has a portion 420 of negative pressure and a portion 422 of positive pressure which are separated by a node 424. For the second higher order (2,0) mode there are two nodal planes 426 and 428 for the shorter side a of the duct 4. As described above, the cut-on frequencies for the various modes propagating in a rectangular duct 4 are described by Equation (1). Note that more complicated modes, such as the (1,1) mode may propagate in addition to other modes depending on duct geometry and the speed of sound through the rectangular duct 4.

The same sort of multi-modal acoustic energy propagation occurs in circular ducts and in ducts having other cross sections. The specific geometric location of positive and negative pressures and nodal planes separating these regions may be different than with a rectangular duct, but the same general principles apply. See the above cited paper by Eriksson, "Higher Order Mode Effects and Circular Ducts and Expansion Chambers" J. Acoust. Soc. Am. 68(2), August, 1980.

A single channel system as shown in FIGS. 1 and 3 does not sense or process enough information to accurately characterize an input acoustic wave if the input acoustic wave has multiple modes. This is primarily because the input microphone 10 cannot distinguish between the plane wave and the higher order modes. This causes problems because the plane wave mode has characteristics different than the higher order modes.

In particular, the plane wave or (0,0) mode has the following characteristic properties: 1) the pressure distribution is uniform in the cross-sectional plane at any instant in time, 2) the velocity of wave propagation along the longitudinal axis of the duct is the speed of sound in free space (i.e., no waveguide) and is independent of frequency, and 3) the plane wave mode is stable and propagates at all frequencies.

In contrast, higher order modes have the following characteristic properties: 1) the pressure distribution is non-uniform in the cross-sectional plane and is different for each higher order mode, 2) the velocity of wave propagation along the longitudinal axis of a duct is slower than the speed of sound in free space and is a function of frequency for each higher order mode, and 3) each higher order mode is stable only above its cut-on frequency.

The result of these contrasting properties means that an input disturbance consisting of several modes, monitored by a single microphone 10 (as shown in FIG. 1 and 3), may be substantially different by the time it propagates to the loudspeaker 14. Since the modal components are, in general, statistically independent, a single input microphone 10 operating in conjunction with a single channel filter 40 does not provide enough information to identify the various modes propagating through the duct 4, and does not accurately predict the acoustic profile at the loudspeaker 14. Thus, with a single channel system, it is difficult to significantly attenuate a multi-mode disturbance.

Figure 9:
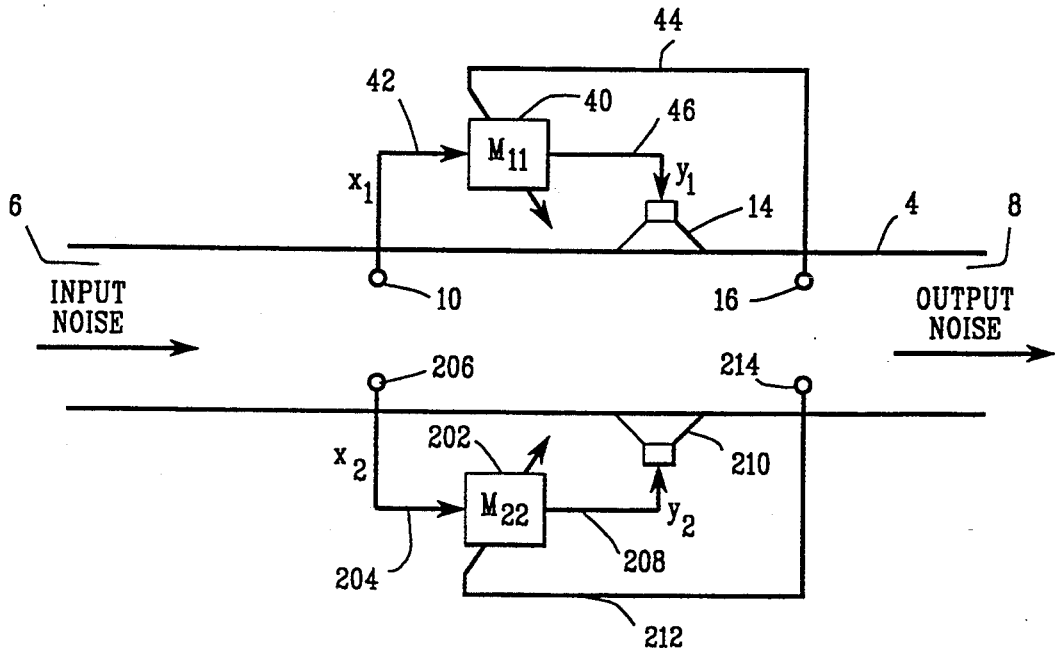
FIG. 9 PRIOR ART
FIG. 9 is a schematic illustration showing a higher order mode system in accordance with the above incorporated U.S. Pat. No. 4,815,139.
Figure 10:
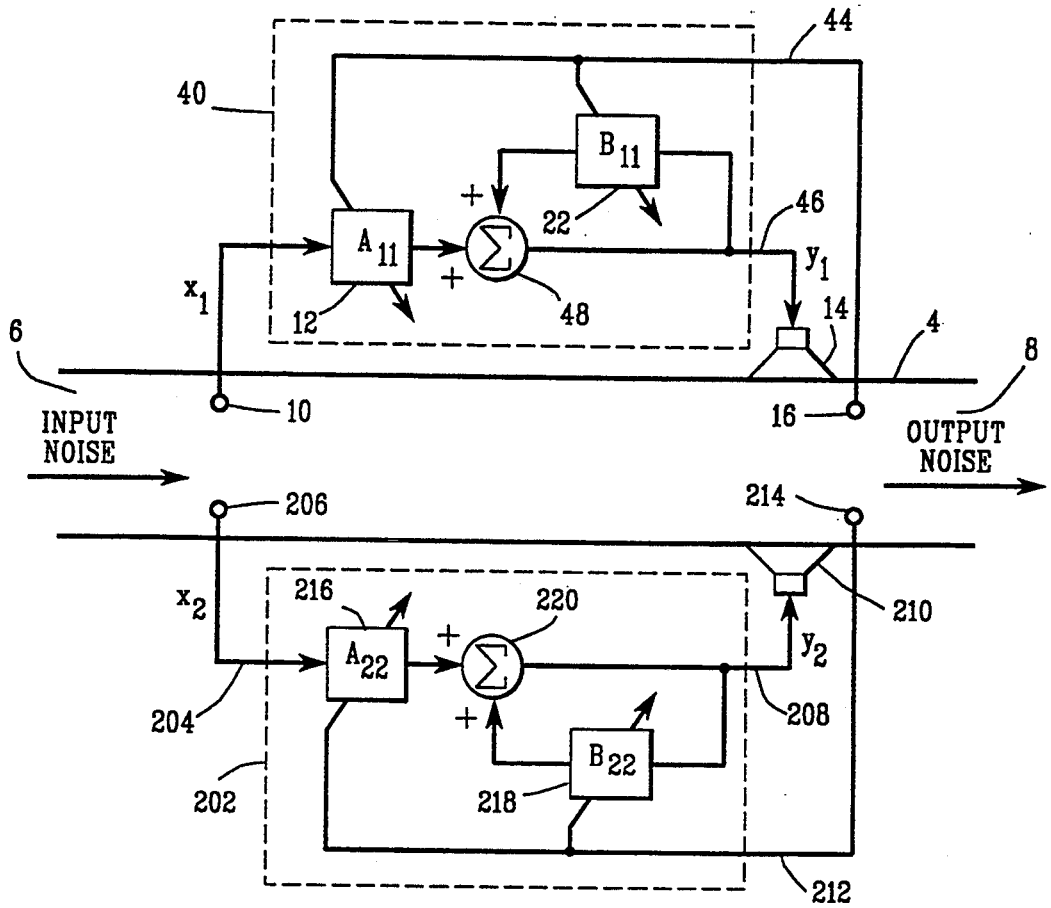
FIG. 10 PRIOR ART
FIG. 10 shows a further embodiment of the system of FIG. 9.

A plural mode system for increasing the frequency range of active acoustic attenuation above $f_c$ is shown in FIGS. 9 and 10. The system shown in FIGS. 9 and 10 is comparable to the system described in FIG. 7 of incorporated U.S. Pat. No. 4,815,139. In FIG. 9, there is a first channel model $M_{11}$ at 40 and a second channel model $M_{22}$ at 202. Each channel model connects a given input sensor, error sensor and actuator. The first channel model $M_{11}$ at 40 is comparable to the adaptive filter model 40 in FIG. 1. Model $M_{22}$ at 202 has a model input 204 provided by input microphone 206, a model output 208 which is a correction signal transmitted to a canceling loudspeaker 210, and an error input 212 provided by error microphone 214. As shown in incorporated U.S. Pat. No. 4,815,139, it is known also to provide further models (i.e., $M_{33}$ with an associated input sensor, error sensor and actuator, etc.) Multiple input transducers 10, 206, etc. may be used for providing plural input signals representing the input acoustic wave, or alternatively only a single input signal may be provided and the same input signal may be input to each of the adaptive filter models. It is believed that the reason for this is that the acoustic pressure at position 10 is related to the acoustic pressure at other positions such as 206 by appropriate transfer functions which are adaptively modeled. As a further alternative to FIG. 9, no input microphone is necessary, and instead the input signal may be provided by a transducer such as a tachometer which provides the frequency of a periodical input acoustic wave. Another further alternative is that the input signal may be provided by one or more error signals, in the case of a periodic noise source, as in "Active Adaptive Sound Control in a Duct; A Computer Simulation", J. C. Burgess, Journal of Acoustic Society of America, 70(3), September, 1981, pages 715–726.

In FIG. 10, the models $M_{11}$ and $M_{22}$ in FIG. 9 are further shown to each be an RLMS adaptive filter model. Model 40 includes LMS filter $A_{11}$ at 12 providing a direct transfer function, and LMS filter $B_{11}$ at 22 providing a recursive transfer function. The output of filters $A_{11}$ and $B_{11}$ are summed at summer 48 having an output which is a correction signal $y_1$ at 46. Model 202 includes LMS filter $A_{22}$ at 216 providing a direct transfer function, and LMS filter $B_{22}$ at 218 providing a recursive transfer function. The outputs of filters $A_{22}$ and $B_{22}$ are summed at summer 220 having an output providing a correction signal $y_2$ at 208. Applying Equation 4 to the system in FIG. 10 yields Equation 5 for $y_1$ and Equation 6 for $y_2$.

$$y_1 = \left(\frac{A_{11}}{1 - B_{11}}\right)x_1 \quad \text{Eq. 5}$$

$$y_2 = \left(\frac{A_{22}}{1 - B_{22}}\right)x_2 \quad \text{Eq. 6}$$

Figure 11:
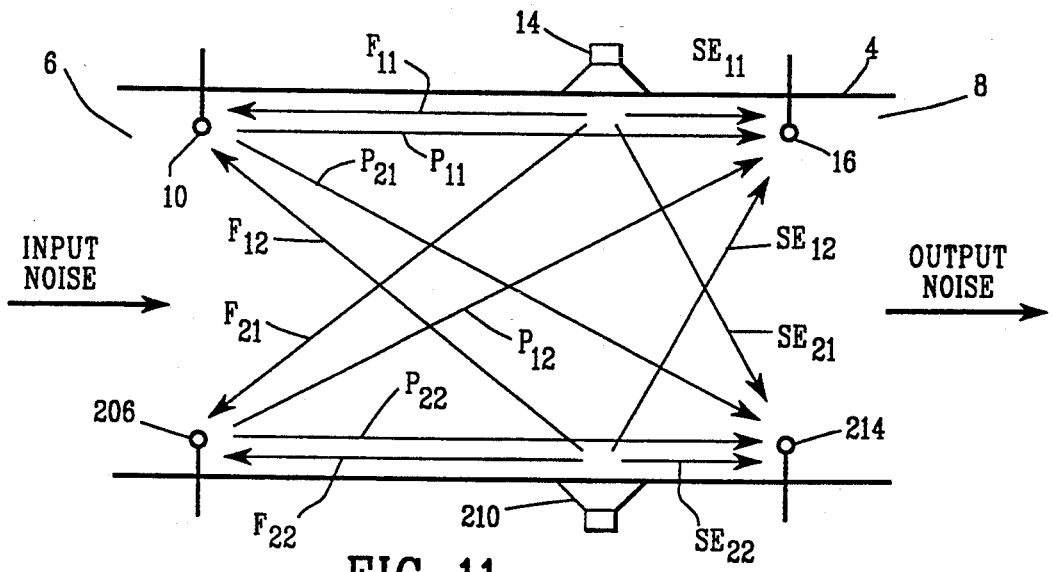
FIG. 11 PRIOR ART
FIG. 11 shows cross-coupled acoustic paths in the system of FIGS. 9 and 10.

FIG. 11 shows an acoustic plant, including the cross-coupling of acoustic paths, of the system shown in FIGS. 9 and 10. In particular, it shows: acoustic path $P_{11}$ to the first error sensor 16 from the first input sensor 10; acoustic path $P_{21}$ to the second error sensor 214 from the first input sensor 10; acoustic path $P_{12}$ to the first error transducer 16 from the second input sensor 206; acoustic path $P_{22}$ to the second error sensor 214 from the second input sensor 206; feedback acoustic path $F_{11}$ to the first input sensor 10 from the first acoustic sensor 14; feedback acoustic path $F_{21}$ to the second input sensor 206 from the first actuator 14; feedback acoustic path $F_{12}$ to the first input sensor 10 from the second actuator 210; feedback acoustic $F_{22}$ to the second input sensor 206 from the second actuator 210; acoustic path $SE_{11}$ to the first error sensor 16 from the first actuator 14; acoustic path $SE_{21}$ to the second error sensor 214 from the first actuator 14; acoustic path $SE_{12}$ to the first error sensor 16 from the second actuator 210; and acoustic path $SE_{22}$ to the second error sensor 214 from the second actuator 210.

The system shown in FIGS. 9 and 10, which is comparable to the system described in U.S. Pat. No. 4,815,139, uses a separate channel to separately model each portion of the duct in which the transducers (i.e. input sensors, error sensors and actuators) are placed. The system shown in FIGS. 9 and 10 can be extended to incorporate n channels, which would have n transfer functions and n error models, and thus require n times the computational power of FIGS. 1 and 3. The system in FIGS. 9 and 10 does not account for the acoustic cross-coupling as shown in FIG. 11.

The system shown in FIG. 12 is comparable to FIG. 7 in U.S. Pat. No. 5,216,721. This system accounts for the cross-coupled acoustic paths described in FIG. 11. The system of FIG. 12 is particularly effective for accounting for cross-coupled terms because the different channel models are intraconnected. That is, the total output signal is used as input to the recursive model elements.

In FIG. 12, LMS filter $A_{21}$ at 302 has an input at 42 from first input transducer 10, and an output summed at summer 304 with output of LMS filter $A_{22}$. LMS filter $A_{12}$ at 306 has an input at 204 from second input transducer 206, and an output summed at summer 308 with the output of LMS filter $A_{11}$. LMS filter $B_{21}$ at 310 has an input from model output 312 and an output summed at summer 313 with the summed outputs of $A_{21}$ and $A_{22}$ and with the output of LMS filter $B_{22}$. Summers 304 and 313 may be common or separate. LMS filter $B_{12}$ at 314 has an input from model output 316, and has an output summed at summer 318 with the summer outputs of $A_{11}$ and $A_{12}$ and the output of LMS filter $B_{11}$. Summers 308 and 318 may be separate or common.

Figure 13:
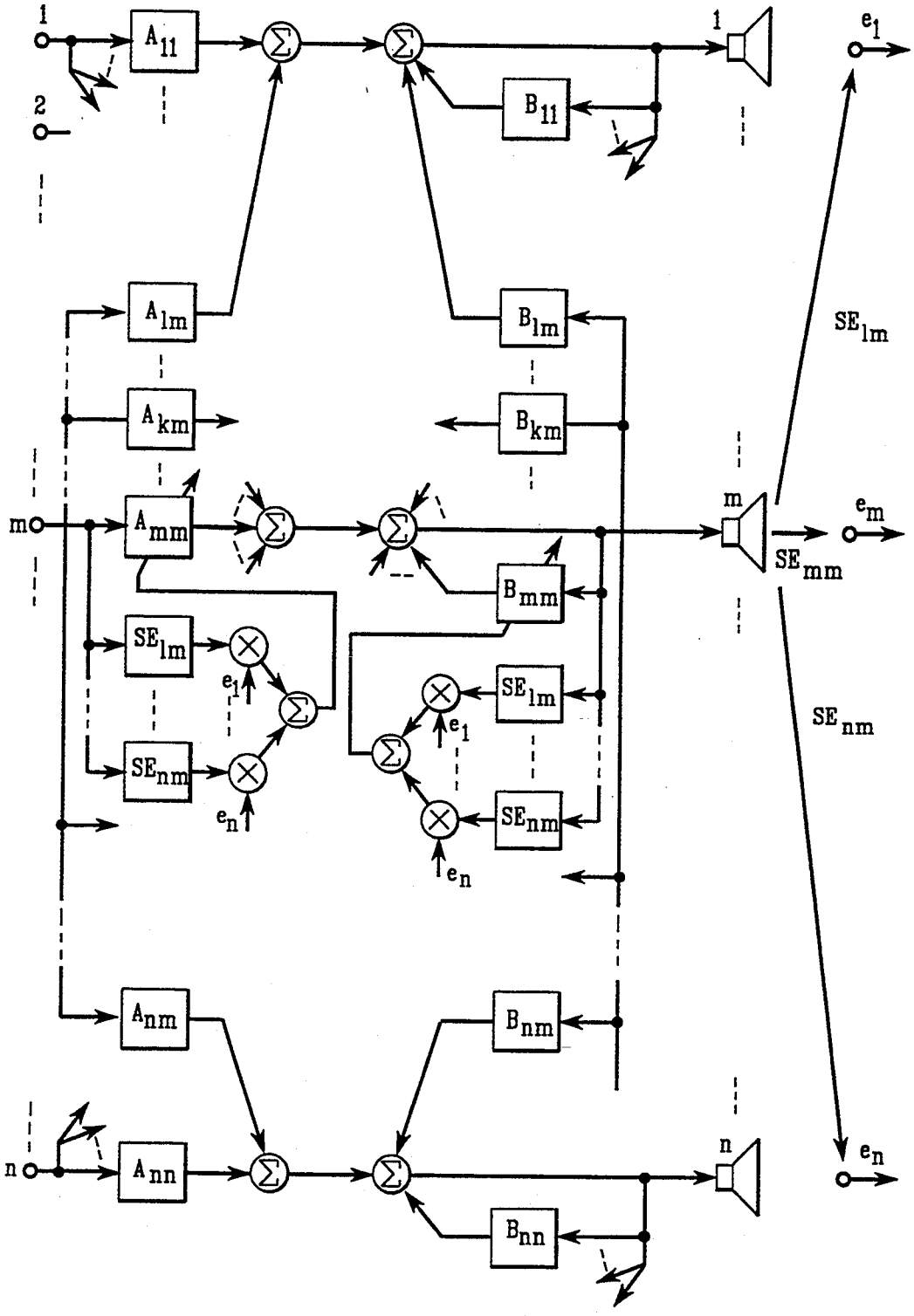
FIG. 13 PRIOR ART
FIG. 13 shows a generalized system in accordance with above incorporated U.S. Pat. No. 5,216,721.

The system shown in FIG. 12 improves the multichannel system of FIGS. 9 and 10 by adding further models of cross-coupled paths between channels, and interconnecting the input and output of each channel with the other channels. In this manner, each of the acoustic paths shown in FIG. 11 can be effectively accounted for during modeling. The result is more attenuation. The system of FIG. 12 can be extended as shown in FIG. 13 to include n channels and to include input from n error sensors. Note that the system of FIG. 13 has $n^2$ transfer functions and $n^2$ error models, and thus requires $n^2$ times the computational power of the system of FIGS. 1 and 3.

Present Invention

FIG. 14 is a schematic illustration showing a two-mode active acoustic attenuation system in accordance with the present invention. The present invention does not model the acoustic paths shown in FIG. 11, including the cross-coupled acoustic paths, in the same manner as the system shown in FIGS. 12 and 13 (i.e. U.S. Pat. No. 5,216,721). Rather, the present invention senses input noise 501 to generate input signals 502 and 504, and separates or decouples signals 502 and 504 in such a manner that a separate processing signal (e.g. 506 or 508) is generated for each of the two modes in the waveguide 500 (i.e. duct 500) that are being attenuated. Since the present invention decouples the input signals 502 and 504 into separate processing signals 506 and 508, separate single channel adaptive filters 510 and 512 can be used to effectively model the acoustic plant 514 within the waveguide 500. The ability to eliminate the need to compensate for cross-coupled acoustic paths as shown in FIG. 11 allows the present invention to operate effectively with much less computing power.

The system shown in FIG. 14 is a two-mode system for attenuating the plane wave mode and the first higher order mode (1,0). It has two input sensors 516 and 518. In particular, input sensors 516 and 518 are located across the waveguide 500 in a designated location. The input sensors 516 and 518 are preferably located so that the input signals 502 and 504 transmitted from the input sensors 516 and 518 are linearly independent to one another in the sense that they can be decoupled to generate a separate processing signal 506 and 508 for each mode of the acoustic wave 501 that is being attenuated. The processing signals 506 and 508 are preferably orthogonal to one another so that each processing signal 506 and 508 represents the magnitude of the corresponding mode only.

Preferably, input sensors 516 and 518 are located in a vertical cross-sectional plane with input sensor 516 being placed below the nodal plane 408 for the first higher order mode (i.e. in negative pressure region 406), and input sensor 518 being placed above nodal plane 408 for the first higher order mode (i.e. a positive pressure region 404). It is further preferred that the input sensors 516 and 518 be located symmetrically about the nodal plane 408, in order to simplify decoupling the signals.

The location of the input sensors 516 and 518 is important because the input signals 502 and 504 should form a complete set of information for characterizing the plane wave and the first higher order mode. There may be configurations for locating the input sensors 516 and 518, other than the above described configuration, that would also provide input signals with a complete set of information for characterizing the plane wave and first higher order mode.

Referring still to FIG. 14, the input signals 502 and 504 are transmitted to a decoupler 520. The decoupler 520 generates a separate processing signal 506 for the plane wave mode and a separate processing signal 508 for the first higher order mode. The decoupler 520 decouples the input signals 502 and 504 by combining the signals 502 and 504 in a linear combination to generate the processing signals 506 and 508. In FIG. 15, the preferred decoupler 520 for the two-mode system is shown in more detail.

Referring to FIG. 15, the decoupler 520 in a two mode system is preferably comprised of a summer 522 for summing input signals 502 and 504 from input sensors 516 and 518, and summer 524 for summing the input signal 502 with the negative of input signal 504. The output of summer 522 is the processing signal 506 for the plane wave mode. The summers 522 and 524 can be either analog or digital.

Figure 5:
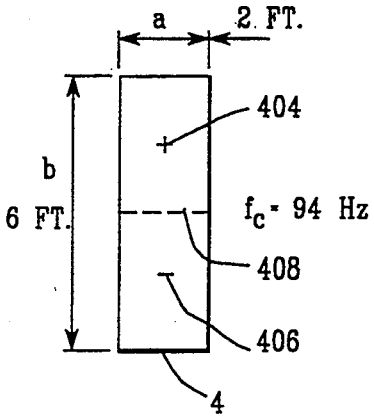
FIG. 5 is a sectional view of the acoustic pressure distribution taken along line 5—5 of FIG. 4.

Referring to FIGS. 1, 2, 4 and 5, it can be seen that the magnitude of processing signal 506 represents twice the magnitude of the propagating plane wave 402 (see FIG. 1). That is, input sensor 518 senses, at that instant of time, the positive pressure of the plane wave 402 shown in FIG. 2, plus the positive pressure 404 above the nodal plane 408 for the first higher order mode as shown in FIG. 5. The other input sensor 516 senses, at that same moment in time, the positive pressure of the plane wave 402 as shown in FIG. 2, the magnitude of the negative pressure 406 below the nodal plane 408 for the first higher order mode as shown in FIG. 5. Summer 522 therefore generates processing signal 506 which represents twice the magnitude of the plane wave 402. In a similar manner, summer 524 generates processing signal 508 which represents twice the magnitude of the first higher order mode wave. In order for the magnitude of processing signal 508 to accurately represent twice the magnitude of the first higher order mode wave, it is preferred that the input sensors 516 and 518 be located symmetrically about the nodal plane 408. The input sensors 516 and 518 can be located on the edge or wall of the waveguide 500. This may be the most practical in commercial air duct systems. Alternatively, the input sensors 516 and 518 can be placed along nodal planes 416 and 418 for the second higher order mode to suppress detecting sound energy in the second higher order mode that could contaminate the input signals 502 and 504 and thus hinder decoupling into two orthogonal signals.

As noted above, it is not necessary to locate the input sensors 516 and 518 symmetrically across the nodal plane 408 for the first higher order mode. In general, decoupling coefficients for the input signals 502 and 504 to generate decoupled processing signals 506 and 508 through linear combination can be determined a priori depending upon the location of the input sensors 516 and 518 in the waveguide 4. The decoupling coefficients can be calculated by knowing the geometry of the waveguide 4 and the placement of the input sensors 516 and 518 in the waveguide 4. Such calculations can be made using the wave equation which is explained in Eriksson, "Higher Order Mode Effects and Circular Ducts and Expansion Chambers", J. Acoust. Soc. Am. 68(2), August, 1980, for example. The calculated decoupling coefficients will be real numbers if the input sensors 516 and 518 are located in the same transverse plane in a cross waveguide 4. If input sensor 516 is located either upstream or downstream from input sensor 518, the decoupling coefficients will in general be complex numbers of the form $Ae^{-j\theta}$, where j is $\sqrt{-1}$, and $\theta$ is a phase shift, since the different modes travel down the duct 4 at different velocities. When complex coefficients are needed, parameters A and $\theta$ should be calculated for each frequency and mode for the given sensor locations and duct geometry. Thus, the decoupling coefficients can be determined with knowledge of the pressure distributions for the various modes, depending on the location of the input sensors 516 and 518. Calculating the decoupling coefficients, in such a manner allows the input signals 502 and 504 to be linearly combined in a manner that the separate processing signals 506 for the plane wave mode and 508 for the first higher order mode are orthogonal. When input sensors 516 and 518 are located symmetrically across the nodal plane 408 for the first higher order mode, the decoupling coefficient for input signal 502 is equal to the decoupling coefficient for input signal 504.

Referring again to FIG. 14, processing signal 506 for the plane wave mode is transmitted to an adaptive filter model 510 to process the plane wave mode signal 506 and generate a separate output signal 526 for the plane wave mode. In particular, the adaptive filter 510 is a single channel filter model having a direct transfer function $A_{11}$ at 528 and a recursive transfer function $B_{11}$ at 530. The outputs from transfer functions $A_{11}$ and $B_{11}$ are summed at summer 532 to generate the modal output signal 526 for the plane wave mode.

In a similar manner, the processing signal 508 for the first higher order mode is transmitted to a separate adaptive filter model 512 to generate an output signal 534 for the first higher order mode. The adaptive filter model 512 for the first higher order mode generates the output signal 534 completely independent of the adaptive filter 510 for the plane wave mode. In particular, the adaptive filter 512 is a single channel model comprising a direct transfer function $A_{22}$ at 536 and a recursive transfer function $B_{22}$ at 538. The output from filters 536 and 538 are summed in a summer 540 to produce the output signal 534 for the first higher order mode. Reference to the incorporated patents should be made for a more particular description of the adaptive filter models 510 and 512.

The output signals 526 and 534 can then be combined in a combiner 542 to generate correction signals 544 and 546 for driving actuators 548 and 550, respectively. In a sound attenuation system, actuators 548 and 550 are typically loudspeakers. Referring to FIG. 15, the combiner 542 has a summer 556 that sums the modal output signals 526 and 534 to generate the correction signal 468 to drive actuator 550. The combiner 542 also has a summer 552 which sums the modal output signal 526 for the plane wave mode with the negative of the modal output signal 534 for the first higher order mode to generate the correction signal 544 to drive actuator 548. It may be preferred that the actuators 548 and 550 be located on the nodal planes 416 and 418 for the second higher order mode. Such an arrangement may deem the actuators to be less likely to generate a second higher order mode component.

The combiner 542 as shown in FIG. 15 is used to independently control the generation of the first two modes (i.e. the plane wave mode and the first higher order mode). When the actuators 548 and 550 are located symmetrically about the nodal plane 408 for the first higher order mode, both actuators 548 and 550 generate plane wave components with the same phase, but generate first higher order mode components having opposite phase. In other words, when both actuators 548 and 550 receive the same signal (i.e. correction signal 544 is identical to correction signal 546), the combined efforts of the actuators 548 and 550 generates a plane wave but no first higher order mode component. On the other hand, when correction signal 544 is the negative of correction signal 546, the combined efforts of actuators 548 and 550 is to generate a first higher order mode component but no plane wave. Thus, the relative magnitudes of the correction signals 544 and 546 can be adjusted to drive actuators 548 and 550 independently of one another in such a manner that the combined acoustic energy of actuators 548 and 550 is appropriately proportioned between the plane wave mode and the first higher order mode.

It should be noted that the magnitude and the phase of the independent correction signals 544 and 546 can be adjusted to account for actuator locations other than those shown in FIG. 15. That is, the combiner 542 can incorporate real or complex combining coefficients that depend on the geometry of the waveguide 4 and the placement of the actuators 548 and 550 within the waveguide 4, so that the combined acoustic energy of actuators 548 and 550 is appropriately proportional between the plane wave mode and the first higher order mode.

Still referring to FIG. 15, the combined output acoustic wave 503 (i.e. the input noise 501 combined with the output from actuators 548 and 550) is sensed with error sensors 560 and 562. The error sensors 560 and 562 are placed in a manner similar to the input sensors 516 and 518 to provide linearly independent error signals 564 and 566. The error signals 564 and 566 are transmitted to an error signal decoupler 568 which preferably is similar to decoupler 520. In the error signal decoupler 568, the error signals 564 and 566 are summed at summer 570 to generate an error processing signal 572 for the plane wave mode. The error processing signal 572 for the plane wave mode is then transmitted to the adaptive filter model 510 for the plane wave mode, where it is the error input into the model. The preferred method of accounting for the plane wave mode error processing signal 572 in adaptive filter model 510 is described in U.S. Pat. No. 4,677,677 which is incorporated as a reference herein. It should also be noted that random noise sources such as those described in incorporated U.S. Pat. No. 4,677,676 can be used to improve modeling in the model 510.

The error signal decoupler 568 has another summer 574 that sums error signal 564 with the negative of error signal 566 to generate an error processing signal 575 for the first higher order mode. Error processing signal 575 is transmitted to the adaptive filter model 512 where it is used in the same manner as signal 572 is in model 510. Likewise, model 512 can also use a random noise source as described in U.S. Pat. No. 4,677,676.

Referring to FIG. 16, the present invention can be applied in a system where n uncorrelated modes are propagating and being attenuated. In general, the same processes occur in an n-mode system as shown in FIG. 16 as in the two-mode system shown in FIGS. 14 and 15.

FIG. 16 shows an n-mode, decoupling active attenuation system in accordance with the present invention. Such a system has n input sensors 579 that generate n input signals 576. The n input signals 576 form a complete set of input signals from which the n separate modes propagating in the waveguide can be characterized. That is, the n input signals 576 are linearly independent and each of the n modes propagating in the waveguide contributes to at least one of the n input signals 576. The input signals 576 are then linearly combined in decoupler 520 in such a manner that a separate orthogonal processing signal 578 is generated for each of the n modes being attenuated.

Note that the coefficients for linearly combining the input signals 576 to generate the modal processing signals 578 can be predetermined in decoupler 520 depending on the number and the location of the input sensors 579. For instance, in a 3-mode system having three input sensors located along the same plane transverse to the waveguide 4 (i.e. $i_1$, $i_2$, $i_3$), where one input sensor $i_2$ is placed on the nodal plane 408 for the first higher order mode, one input sensor $i_1$ is placed on the upper nodal plane 416 for the second higher order mode, and another input sensor $i_3$ is placed on the other nodal plane 418 for the second higher order mode, appropriate linear combinations would be as follows:

$$PS_{pw}=\tfrac{1}{3}(IS_1+IS_2+IS_3) \quad \text{Eq. 7a}$$

$$PS_1=\tfrac{1}{2}(IS_1-IS_3) \quad \text{Eq. 7b}$$

$$PS_2=IS_2-\tfrac{1}{2}(IS_1+IS_3) \quad \text{Eq. 7c}$$

where $PS_{pw}$, $PS_1$ and $PS_2$ refer to processing signals 578 for the plane wave mode, first higher order mode, and second higher order mode, respectively; and $IS_1$, $IS_2$ and $IS_3$ refer to input signals 576 generated by input sensors 579, $i_1$, $i_2$ and $i_3$, respectively.

The processing signals 578 are each transmitted to separate adaptive filter models 580. The n adaptive filter models 580 also receive decoupled error processing signals 582 from the error signal decoupler 584. The error signal decoupler 584 receives n error signals 586 from n error sensors 588 (i.e. $e_i \ldots e_m \ldots e_n$). The placement of the n error sensors 588 is analogous to the placement of the n input sensors 579. Likewise, the decoupling of the error signals 586 is analogous to the decoupling of the input signals 576.

The nth adaptive filter model 580 generates an output signal 590 for the nth mode. Each of the n adaptive filter models 580 is essentially the same as the filter models 510 and 512 described above for the two-mode system.

The separate output signals 590 are linearly combined in combiner 592 to generate a correction signal 594 for each of n actuators 596 (i.e. $a_i \ldots a_m \ldots a_n$). The combiner 592 combines the modal output signals 590 in such a manner that the combined effort of the n actuators can be adjusted to independently control the amount of acoustic excitation for each of the n modes (i.e. plane wave mode plus n−1 higher order modes). It is preferred that the n actuators are located on the nodal plane for the $n^{th}$ higher order mode. This will reduce excitement of the $n^{th}$ higher order mode by the actuators 596. When placement of the actuators on the $n^{th}$ higher order nodal plane is not practical, it is still preferred to place the actuators 596 in positions symmetrical about the n−1 higher order mode nodal planes.

Referring to FIG. 8, the system in FIG. 16 can operate to decouple mixed modes, such as the (1,1) mode if the input sensors 579, and error sensors 588 are properly placed.

Likewise, it should be understood that the present invention is useful for systems not having rectangular waveguides, such as systems having a waveguide with a circular or other-shaped cross-section.

In general, the system of the present invention is not only useful for sound attenuation in ducts, but also for attenuating any elastic wave propagating in an elastic medium, where the elastic wave has a non-uniform pressure distribution in the medium at a given instant in time along the direction transverse to the direction to propagation. Thus, the term acoustic wave as used herein includes any such elastic wave, and the term waveguide as used herein includes any structure for guiding an acoustic wave through an elastic medium, including solid, liquid or gas. For example, waveguides include ducts, impedance tubes, and vibration structures such as beams, plates, etc. An acoustic wave propagating through a waveguide is sensed with an acoustic sensor, such as a microphone in a sound application, or an accelerometer in vibrational applications, etc. An acoustic wave can be generated by an acoustic actuator, such as a loudspeaker in a sound application or a shaker in vibrational applications, etc.

It is recognized that various equivalents, alternatives, and modifications of the present invention are possible and should fall within the scope of the claims.

I claim:

1. A method for attenuating one or more modes of an input acoustic wave propagating longitudinally along a waveguide, comprising:

determining input sensing locations so that input signals generated for each input sensing location are linearly independent to one another, the number of input sensing locations being equal to the number of uncorrelated modes being attenuated;

sensing the input acoustic wave at each input sensing location to generate separate input signals;

decoupling the separate input signals to generate an input processing signal for each mode of the acoustic wave being attenuated;

processing each input processing signal independently of the other input processing signals to generate a separate modal output signal for each mode of the acoustic wave being attenuated; and generating a canceling acoustic wave in response to the modal output signals.

2. A method as recited in claim 1 where only the plane wave mode and the first higher order mode are attenuated; and a first input sensing location is within the waveguide on one side of the nodal plane for the first higher order mode, and a second input sensing location is at another position in the waveguide that is symmetrically located on another side of the nodal plane for the first higher order mode.

3. A method as recited in claim 2 wherein the first and second input sensing locations are positioned on nodal planes for the second higher order mode.

4. A method as recited in claim 1 wherein the input sensing locations are at the nodal planes for the next higher order mode than the highest order mode being attenuated.

5. A method as recited in claim 1 wherein only the plane wave mode and the first higher order mode are being attenuated and the separate input signals are decoupled by:

summing the separate input signals to generate a signal proportional to the input processing signal for the plane wave mode; and summing one of the input signals with the negative of the other input signal to generate the input processing signal for the first higher order mode.

6. A method as recited in claim 1 wherein the separate input signals are decoupled by linearly combining the separate input signals in such a manner that the input processing signal generated for each mode being attenuated is orthogonal to the other input processing signals being generated for the other modes.

7. A method as recited in claim 6 wherein each sensing location is on the same transverse plane across the waveguide, and the linear combination of the separate input signal is accomplished using decoupling coefficients that are real numbers.

8. A method as recited in claim 6 wherein the sensing locations are not located on the same transverse plane across the waveguide, and the linear combination of the separate input signals is accomplished using decoupling coefficients that are in general complex numbers representing a magnitude and a phase shift.

9. A method as recited in claim 1 wherein the canceling acoustic wave is generated by:

forming a linear combination of the separate modal output signals to generate an independent correction signal corresponding to a generation location, and generating a corresponding acoustic wave in response to each independent correction signal, each acoustic wave being generated at a generation location whose modal excitation of the waveguide is linearly independent to that of the other generation locations, the number of generation locations being at least equal to the number of separate modal output signals, wherein the acoustic summation of the generated acoustic waves is the canceling acoustic wave.

10. A method as recited in claim 9 wherein the generation locations are located generally on the same transverse plane across the waveguide, and forming the linear combinations of the separate modal output signals is accomplished using combining coefficients that are real numbers.

11. A method as recited in claim 9 wherein the generation locations are not located generally on the same transverse plane across the waveguide, and forming the linear combination of the separate modal output signals is accomplished using combining coefficients that are in general complex numbers representing an amplitude and a phase shift.

12. A method as recited in claim 9 wherein the generation locations are positioned on the nodal planes for the next higher order mode than the highest order being attenuated.

13. A method as recited in claim 1 further comprising the steps of:

determining error sensing locations so that error signals generated for each error sensing location are linearly independent to one another, the number of error sensing locations being equal to the number of uncorrelated modes being attenuated;

sensing an error acoustic wave at each error sensing location to generate separate error signals;

decoupling the separate error signals to generate a separate error modal processing signal for each mode of the acoustic wave being attenuated;

processing each error processing signal independent of the other error processing signals to generate a separate modal output signal for each mode being attenuated, wherein the modal output signals for each mode being attenuated are generated in response to both the corresponding input processing signal and the corresponding error processing signal.

14. A method as recited in claim 13 wherein only a plane wave mode and a first higher order mode are being attenuated; and a first error sensing location is within the waveguide on one side of the nodal plane for the first higher order mode, and a second error sensing location is at another position in the waveguide that is symmetrically located on another side of the nodal plane for the first higher order mode.

15. A method as recited in claim 14 wherein the first and second error sensing locations are positioned on nodal planes for the second higher order mode.

16. A method as recited in claim 13 wherein the error sensing locations are at the nodal planes for the next higher order mode than the highest order mode being attenuated.

17. A method as recited in claim 13 wherein the separate error signals are decoupled by linearly combining the separate error signals in such a manner that the error processing signal generated for each mode being attenuated is orthogonal to the other error processing signals being generated for the other modes.

18. A method as recited in claim 17 wherein each error sensing location is on the same transverse plane across the waveguide, and the linear combination of the separate error signals is accomplished using decoupling coefficients that are real numbers.

19. A method as recited in claim 17 wherein the error sensing locations are not located on the same transverse plane across the waveguide, and the linear combination of the separate error signals is accomplished using decoupling coefficients that are in general complex numbers representing an amplitude and a phase shift.

20. A method as recited in claim 1 wherein the acoustic wave is a sound wave and the waveguide is a duct.

21. A method for attenuating one or more modes of an input acoustic wave propagating longitudinally along a waveguide, comprising the steps of:

determining error sensing locations so that error signals generated for each error sensing location are linearly independent to one another, the number of error sensing locations being equal to the number of uncorrelated modes being attenuated;

sensing an error acoustic wave at each error sensing location to generate separate error signals;

decoupling the separate error signals to generate an error processing signal for each mode being attenuated;

processing each error processing signal independently of the other error processing signals to generate a separate modal output signal for each mode of the acoustic wave being attenuated; and generating a canceling acoustic wave in response to the modal output signals.

22. A method as recited in claim 21 wherein the separate error signals are decoupled by linearly combining the separate error signals in such a manner that the error processing signal generated for each mode being attenuated is orthogonal to the error processing signals for the other modes being attenuated.

23. A method as recited in claim 22 wherein each error sensing location is located on the same transverse plane across the waveguide, and the linear combination of the separate error signals is accomplished using decoupling coefficients which are real numbers.

24. A method as recited in claim 22 wherein the error sensing locations are not located on the same transverse plane across the waveguide, and the linear combination of the separate error signals is accomplished using decoupling coefficients that are complex numbers representing an amplitude and phase shift.

25. A method as recited in claim 22 wherein only a plane wave mode and a first higher order mode are being attenuated; and a first error sensing location is within the waveguide on one side of the nodal plane for the first higher order mode, and a second error sensing location is at another position in the waveguide that is symmetrically located on another side of the nodal plane for the first higher order mode.

26. A method as recited in claim 25 wherein the first and second error sensing locations are positioned on nodal planes for the second higher order mode.

27. A method as recited in claim 21 wherein the error sensing locations are at the nodal planes for the next higher order node than the highest order mode being attenuated.

28. A method as recited in claim 21 wherein the acoustic wave is a sound wave and the waveguide is a duct.

29. An active acoustic attenuation system for attenuating one or more modes of an acoustic wave propagating longitudinally along a waveguide, the system comprising:

at least as many acoustic input sensors as the number of uncorrelated modes being attenuated, each input sensor generating a separate input signal, and each input sensor being placed at a location across the waveguide in which the input signal generated by the input sensor is linearly independent to the input signals generated by the other input sensors;

means for decoupling the separate input signals to generate an input processing signal for each mode of the acoustic wave being attenuated;

an independent single channel filter for processing each input processing signal independently of the other input processing signals to generate a separate correction signal corresponding to each mode of the acoustic wave being attenuated.

30. A system as recited in claim 29 further comprising:

at least as many actuators as to the number of uncorrelated modes of the acoustic wave being attenuated, each actuator generating an acoustic output such that the acoustic combination of the acoustic outputs from the actuators is a canceling acoustic wave; and means for combining the separate correction signals from the single channel filters in such a manner that the actuators can be driven to control the excitation of each mode independently.

31. A system as recited in claim 29 further comprising:

at least as many acoustic error sensors as the number of uncorrelated modes being attenuated, each error sensor generating a separate error signal and being placed at a location across the waveguide in which the error signal generated by the error sensor is linearly independent of the error signals generated by the other error sensors; and means for decoupling the separate error signals to generate an error processing signal for each mode of the acoustic wave being attenuated;

wherein the independent single channel filter processes the input and error processing signals corresponding to each mode, independently of the other input and error processing signals, to generate a separate correction signal corresponding to each mode of the acoustic wave being attenuated.

32. A system as recited in claim 29 wherein each of the independent single channel filters is a single channel adaptive recursive filter having a transfer function with both poles and zeros.

33. A system as recited in claim 29 wherein each of the independent single channel filters is an electronic controller.

34. A system as recited in claim 29 wherein the means for decoupling the separate input signals comprises at least as many analog summers as input sensors, and each analog summer linearly combines the separate input signals to generate an input processing signal for each mode of the acoustic wave being attenuated.

35. A system as recited in claim 31 wherein the means for decoupling the separate error signals comprises at least as many analog summers as error sensors, and each analog summer linearly combines the separate error signals to generate an error processing signal for each mode being attenuated.

36. A system as recited in claim 29 in which only the plane wave mode and the first higher order mode are attenuated, and wherein:

one input sensor is located in the waveguide on one side of the nodal plane for the first higher order mode; and the other input sensor is located symmetrically in the waveguide on the other side of the nodal plane for the first higher order mode.

37. A system as recited in claim 36 wherein the input sensors are placed on nodal planes for the second higher order mode.

38. A system as recited in claim 29 wherein the input acoustic sensors are located on the nodal planes for the next higher order mode than the highest order mode being attenuated.

39. A system as recited in claim 31 in which only the plane wave mode and the first higher order mode are attenuated, and wherein:

one error sensor is located in the waveguide on one side of the nodal plane for the first higher order mode; and the other error sensor is located symmetrically in the waveguide on the other side of the nodal plane for the first higher order mode.

40. A system as recited in claim 39 wherein the error sensors are placed on nodal planes for the second higher order mode.

41. A system as recited in claim 31 wherein the error sensors are located on nodal planes for the next higher order mode than the highest order mode being attenuated.

42. A system as recited in claim 30 wherein the actuators are located over nodal planes for the next higher order mode than the highest order mode being attenuated.

43. A system as recited in claim 30 in which only the plane wave mode and the first higher order mode are attenuated, and wherein:

one actuator is located in the waveguide on one side of the nodal plane for the first higher order mode; and the other actuator is located symmetrically in the waveguide on the other side of the nodal plane for the first higher order mode.

44. A system as recited in claim 43 wherein the actuators are placed over nodal planes for the second higher order mode.

45. A system as recited in claim 29 wherein the acoustic wave being attenuated is a sound wave, the waveguide is a duct, and the input acoustic sensors are input microphones.

46. A system as recited in claim 30 wherein the acoustic wave being attenuated is a sound wave and the waveguide is a duct, and wherein:

the input acoustic sensors are input microphones; and the actuators are loudspeakers.

47. A system as recited in claim 30 wherein the means for combining the separate correction signals from the single channel filter comprises:

at least as many analog summers as actuators, wherein each analog summer linearly combines the separate correction signals from the single channel filters in such a manner that the actuators can be driven to control the excitation of each mode independently.

48. A system as recited in claim 29 wherein the waveguide has a rectangular cross-section.

49. A system as recited in claim 29 wherein the waveguide has a circular cross-section.

50. An active acoustic attention system for attenuating one or more modes of an acoustic wave propagating longitudinally along a waveguide, the system comprising:

at least as many acoustic error sensors as the number of uncorrelated modes being attenuated, each error sensor generating a separate error signal, and each error sensor being placed at a location across the waveguide in which the error signal generated by the error sensor is linearly independent of the error signals generated by the other error sensors;

means for decoupling the separate error signals to generate an error processing signal for each mode of the acoustic wave being attenuated; and an independent single channel filter for processing each error processing signal independently of the other error processing signals to generate a separate correction signal corresponding to each mode of the acoustic wave being attenuated.

51. A system as recited in claim 50 further comprising:

at least as many actuators as the number of uncorrelated modes of the acoustic wave being attenuated, each actuator generating an acoustic output such that the acoustic combination of the acoustic outputs from the actuators is a canceling acoustic wave; and means for combining the separate correction signals from the single channel filters in such a manner that the actuators can be driven to control the excitation of each mode independently.

52. A system as recited in claim 50 wherein each of the independent single channel filters is a single channel adaptive recursive filter having a transfer function with both poles and zeros.

53. A system as recited in claim 50 wherein each of the independent single channel filters is an electronic controller.

54. A system as recited in claim 50 wherein the means for decoupling the separate error signals comprises at least as many analog summers as error sensors, and each analog summer linearly combines the separate error signals to generate an error processing signal for each mode of the acoustic wave being attenuated.

55. A system as recited in claim 50 in which only the plane wave mode and the first higher order mode are attenuated, and wherein:

one error sensor is located in the waveguide on one side of the nodal plane for the first higher order mode; and the other error sensor is located symmetrically in the waveguide on the other side of the nodal plane for the first higher order mode.

56. A system as recited in claim 55 wherein the error sensors are placed on nodal planes for the second higher order mode.

57. A system as recited in claim 50 wherein the error sensors are located on nodal planes for the next higher order mode than the highest order mode being attenuated.

58. A system as recited in claim 51 wherein the actuators are located over nodal planes for the next higher order mode than the highest order mode being attenuated.

59. A system as recited in claim 51 in which only the plane wave mode and the first higher order mode are attenuated, and wherein:

one actuator is located in the waveguide on one side of the nodal plane for the first higher order mode; and the other actuator is located symmetrically in the waveguide on the other side of the nodal plane for the first higher order mode.

60. A system as recited in claim 59 wherein the actuators are placed over nodal planes for the second higher order mode.

61. A system as recited in claim 50 wherein the acoustic wave being attenuated is a sound wave, the waveguide is a duct, and the acoustic error sensors are error microphones.

62. A system as recited in claim 51 wherein the acoustic wave being attenuated is a sound wave and the waveguide is a duct, and wherein:

the acoustic error sensors are error microphones; and the actuators are loudspeakers.

63. A system as recited in claim 51 wherein the means for combining the separate correction signals from the single channel filter comprises:

at least as many analog summers as actuators, wherein each analog summer linearly combines the separate correction signals from the single channel filters in such a manner that the actuators can be driven to control the excitation of each mode independently.

64. A system as recited in claim 50 wherein the waveguide has a rectangular cross-section.

65. A system as recited in claim 50 wherein the waveguide has a circular cross-section.

* * * * *